US011525249B1

(12) United States Patent
Yan

(10) Patent No.: US 11,525,249 B1
(45) Date of Patent: Dec. 13, 2022

(54) TOP SPRAY-WATER OUTLET DEVICE

(71) Applicant: XIAMEN GALENPOO KITCHEN & BATHROOM TECHNOLOGY CO., LTD, Xiamen (CN)

(72) Inventor: Xiaoling Yan, Xiamen (CN)

(73) Assignee: XIAMEN GALENPOO KITCHEN & BATHROOM TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 17/847,187

(22) Filed: Jun. 23, 2022

(51) Int. Cl.

| | |
|---|---|
| ***E03C 1/04*** | (2006.01) |
| ***B05B 15/62*** | (2018.01) |
| ***B05B 1/16*** | (2006.01) |
| ***B05B 1/18*** | (2006.01) |
| ***E03C 1/02*** | (2006.01) |

(52) U.S. Cl.
CPC ..... *E03C 1/0408* (2013.01); *B05B 1/16* (2013.01); *B05B 1/18* (2013.01); *B05B 15/62* (2018.02); *E03C 2001/026* (2013.01)

(58) Field of Classification Search
CPC .. B05B 1/16; B05B 1/18; B05B 1/185; B05B 15/62; E03C 1/0408
See application file for complete search history.

(56) References Cited

U.S. PATENT DOCUMENTS

| | | | | |
|---|---|---|---|---|
| 8,720,799 | B2 * | 5/2014 | Tseng | B05B 1/1636 239/443 |
| 10,159,993 | B1 * | 12/2018 | Lin | E03C 1/0409 |
| 10,246,860 | B1 * | 4/2019 | Wu | F16B 2/12 |
| 2005/0098661 | A1 * | 5/2005 | Lev | E03C 1/0404 239/549 |
| 2007/0022528 | A1 * | 2/2007 | Gilbert | E03C 1/06 4/615 |
| 2009/0007330 | A1 * | 1/2009 | Genord | B05B 1/18 4/695 |
| 2018/0104707 | A1 * | 4/2018 | Lin | B05B 1/1609 |
| 2018/0193851 | A1 * | 7/2018 | L'Henaff | E03C 1/0409 |
| 2019/0054479 | A1 * | 2/2019 | Luo | B05B 1/16 |
| 2020/0385968 | A1 * | 12/2020 | Wu | E03C 1/06 |

* cited by examiner

*Primary Examiner* — Darren W Gorman
(74) *Attorney, Agent, or Firm* — Bayramoglu Law Offices LLC

(57) ABSTRACT

A top spray-water outlet device includes a top spray body, a switching device, clamping jaws, and elastic members. A water inlet, a shower water outlet and two top-spray water outlets are provided in the middle of an upper end of the top spray body. The water inlet is respectively connected to the shower water outlet and the top-spray water outlets. The switching device is arranged on one side above the top spray body. Upper and lower surfaces of the clamping jaw are respectively provided with a rotating shaft and a number of water outlet holes. The rotating shaft is rotatably fitted at the top-spray water outlet and is movably sealed. A water inlet hole is provided above the rotating shaft. The clamping jaws can function as a clamping mechanism to fix the hand shower and also as a water outlet device to spray water in this way.

9 Claims, 4 Drawing Sheets

TOP SPRAY-WATER OUTLET DEVICE

TECHNICAL FIELD

This invention relates to the technical field of water outlet devices, in particular to a top shower head water outlet device.

BACKGROUND

The shower head, also known as shower nozzle, is a common bathroom shower device. At present, in order to meet the needs of different customers, the shower heads available on the market have a variety of water outlet methods. A combined shower head is usually a combination of a hand shower and a top spray. The hand shower and the top spray can be used separately or combined together.

Since the existing combined shower head has opened a card slot matching the hand shower on the water outlet panel of the top spray, the top spray can only be adapted to a hand shower which meets a suitable size. Their fixing method is not only not firm enough, but also has certain limitations when replacing accessories in the later period such as hand shower.

SUMMARY

(I) Technical Problem to be Solved

The present invention is directed to the deficiencies of the prior art and provides a top spray-water outlet device, which solves the problems of insecure fixation and limitations caused by replacement of accessories.

(II) Technical Solution

In order to achieve the above objective, the present invention is implemented through the following technical solution: a top spray water outlet device includes a top spray body, a switching device, clamping jaws and elastic member. There are a water inlet, a shower water outlet and two top-spray water outlets provided in the middle of the upper end of the top spray body. The water inlet is connected to the shower water outlet and the top-spray water outlets.

The switching device is arranged on the top side of the top spray body.

The upper and lower surfaces of the clamping jaw is respectively provided with a rotating shaft and a number of water outlet holes; the rotating shaft is rotatably fitted with the top-spray water outlet and movably sealed, the water inlet hole is provided above the rotating shaft, the water inlet hole is connected to the water outlet hole, and the water inlet is connected to one end of the water outlet.

The elastic members are arranged above the clamping jaw.

Preferably, the top spray body includes a cover body and a bottom plate.

The water inlet channel is arranged above the cover body, and the shower water outlet is provided on one side of the water inlet.

One end of the water outlet channel is connected with the water inlet channel, and both sides of the water inlet channel are respectively provided with a top-spray water outlet.

Preferably, a T-shaped drainage groove is fixedly connected to the bottom plate, and a cover plate is inserted into the interior of the drainage groove.

The two top-spray water outlets are located at the ends of both sides of the drainage groove.

The cover plate and the drainage groove are sealed to form the water outlet channel, the water inlet channel is arranged above the cover plate, and a water inlet pipe is inserted into the water inlet channel.

Preferably, the switching device includes a switch lever, a seal and a limit joint;

The switch lever is a hollow structure, one end of the switch lever is fixedly connected with a handle, and the other end of the switch lever is rotatably fitted in the shower water outlet and inserted into the water inlet channel.

A water passage hole and a water passage groove are respectively provided at two sides of the other end of the switch lever, the water passage hole is connected to the inside of the switch lever, and the seal is fitted at an edge of the water passage hole.

The limit joint is fixedly installed at the opening of the shower water outlet.

Preferably, the rotating shaft is inserted into the top-spray water outlet and fixed with a C-shaped fastener.

Preferably, a tension spring is provided inside the elastic member, and the tension spring is located inside the top spray body.

The upper surface of the clamping jaw is fixedly connected with a fixing column.

The lower surface of the top spray body is provided with a first arc hole, and the fixing column is movably fitted in the first arc hole.

Preferably, one end of the upper surface of the clamping jaw is fixedly connected with a snap joint, the lower surface of the top spray body is fixedly connected with a second arc hole, and the snap joint is in rotating fit with the second arc hole and hooked on an inner edge of the second arc hole.

Preferably, two pieces of rubber pads are fixedly connected to the opposite surfaces of the two clamping jaws.

Preferably, a ball head device is fixedly connected to a top of the water inlet, and a hand shower is fixedly connected to one end of the top spray body.

Working principle: The water inlet operation of the water inlet hole 33 is implemented through the ball head device 7 at the top of the hand shower 8; the shower head is switched on or off through the switching device 2; through the top spray body 1, the switching device 2, the left and right clamping jaws 3, and the elastic members 4, the top spray body 1 is provided with a water inlet 1A, a shower water outlet 1B and two top spray water outlets 1C, and the water inlet 1A is respectively connected with the shower outlet 1B and the top spray outlet 1C; the switching device 2 is arranged on the top spray body 1 to switch on or off the connection of the water inlet 1A with the shower water outlet 1B and with the top-spray water outlets 1C; the upper and lower surfaces of the clamping jaw 3 are respectively provided with a rotating shaft 31 and a number of water outlet holes 32; the rotating shaft 31 is rotatably fitted at the top-spray water outlet 1C and movably sealed, also provided with a water inlet hole 33, and the water inlet hole 33 is connected to the water outlet holes 32 so that the water inlet 1A can be connected to the water outlet holes 32; the elastic member 4 acts on the clamping jaws 3 so that the two clamping jaws 3 perform a clamping action with respect to the rotating shaft 31.

(III) Beneficial Effect

This invention provides a top spray-water outlet device. This invention has the beneficial effects as below:

1. According to this invention, the clamping jaws can not only be used as a clamping mechanism to fix the hand shower but also can be used as a water outlet device to spray water. Even if the hand shower is fixed on the top spray, the water from the top spray will not be affected. Meanwhile, due to the function of the elastic members, the clamping jaws can maintain the tendency to move toward each other, thereby clamping different sizes of hand showers, and making the top spray more firmly fixed to the hand shower, achieve a wider application range and better user experience.

In the figures, 1, top spray body; 11, cover body; 111, water inlet channel; 12, bottom plate; 121, water outlet channel; 1211, drainage groove; 1212, cover plate; 1213, water inlet pipe; 122, first arc hole; 123, the second arc hole; 1A, water inlet; 1B, shower water outlet; 1C, top-spray water outlet; 2, switching device; 21, switch lever; 211, handle; 212, water passage hole; 213, water passage groove; 22, seal; 23, limit joint; 3, clamping jaw; 31, rotating shaft; 32, water outlet hole; 33, water inlet hole; 34, fixing column; 35, snap joint; 4, elastic member; 5, C-shaped fastener; 6, rubber pad; 7, ball head device; 8, hand shower.

DETAILED DESCRIPTION OF THE EMBODIMENTS

The technical solutions in the embodiments of this invention will be clearly and completely described as below with reference to the accompanying drawings in the embodiments of this invention. And it will be apparent that the embodiments described here are merely a part, not all of the embodiments of this invention. Based on the embodiments of this invention, all other embodiments obtained by those of ordinary skill in the art without creative efforts shall fall within the protection scope of this invention.

Embodiment 1

Figure 1:
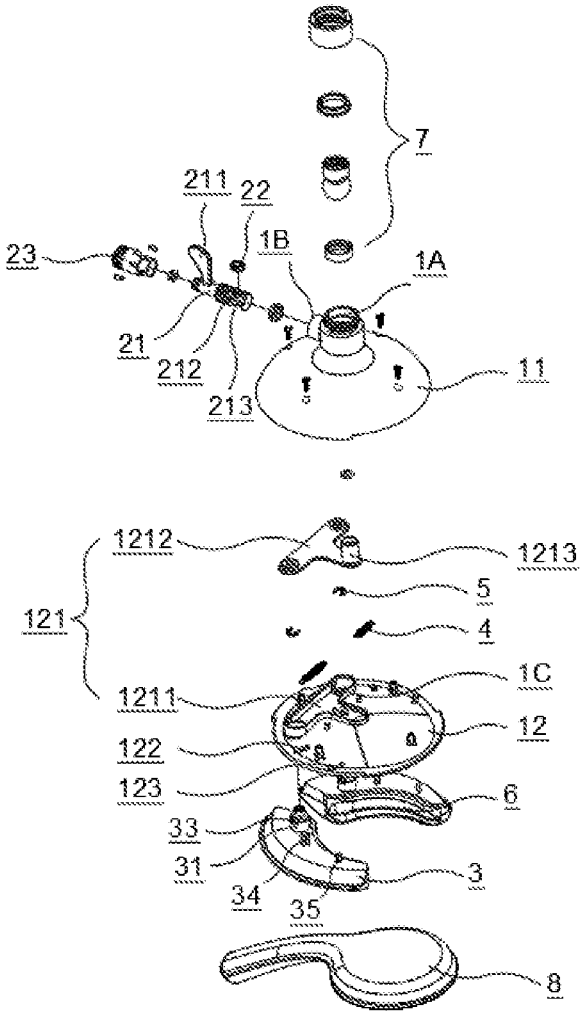
FIG. 1 is an exploded diagram of this invention.
Figure 2:
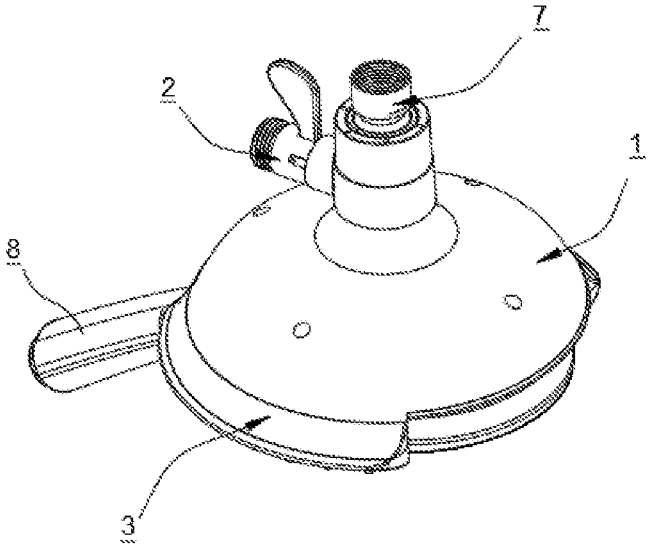
FIG. 2 is a schematic three-dimensional diagram of this invention.
Figure 3:
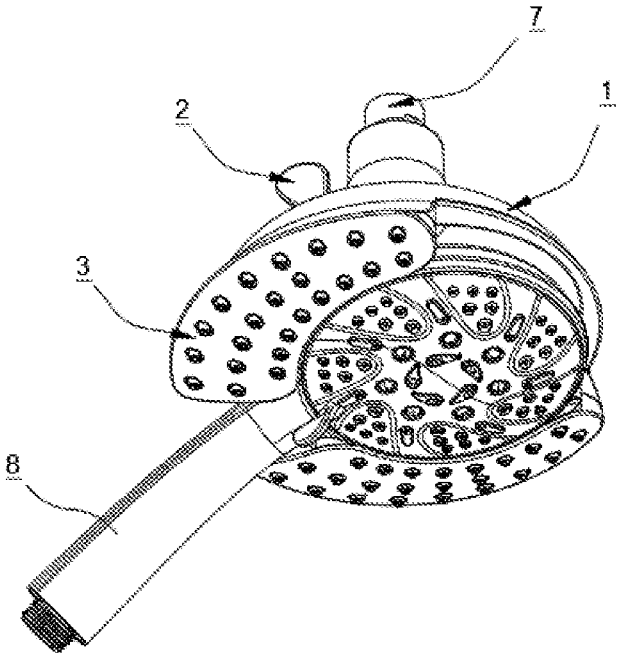
FIG. 3 is a top view of this invention.
Figure 4:
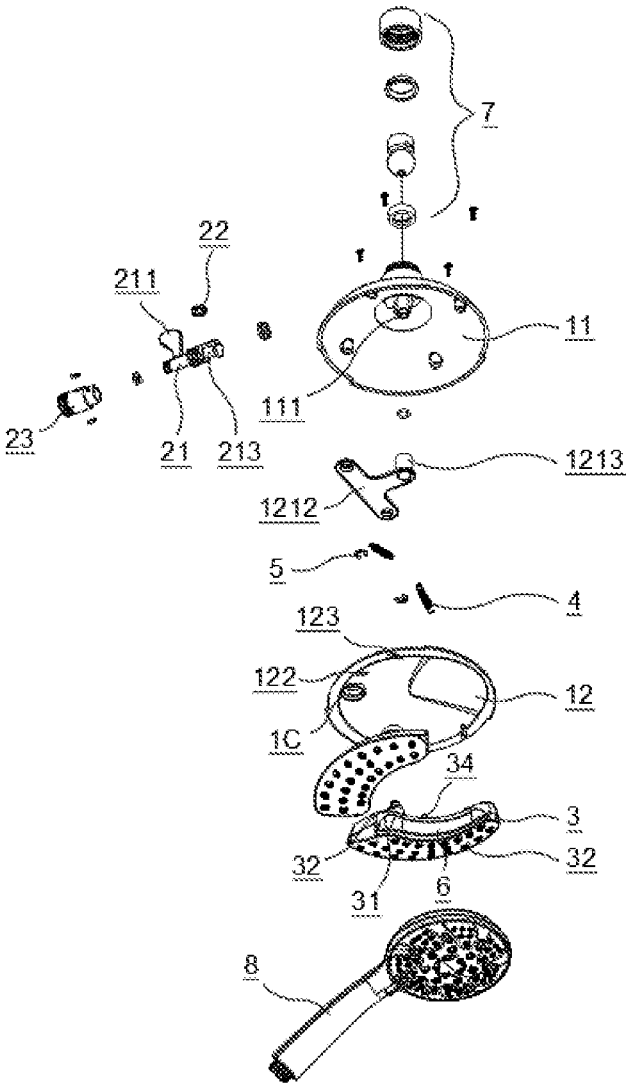
FIG. 4 is a top-view exploded diagram of this invention.
Figure 5:
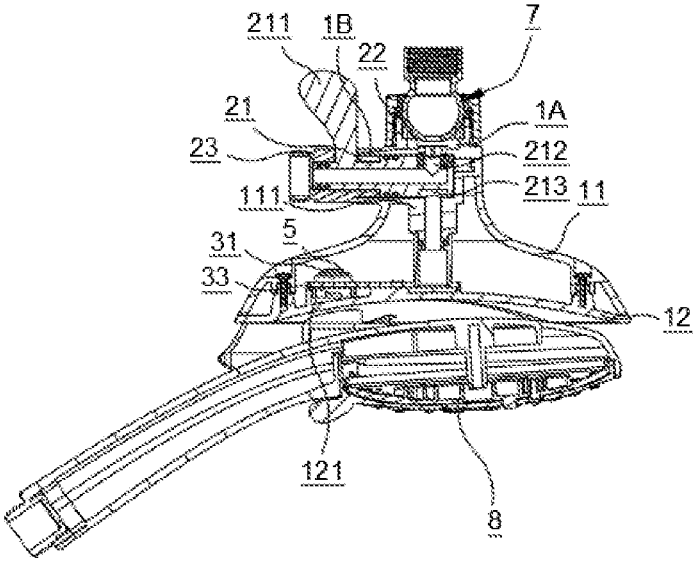
FIG. 5 is a side-view schematic cross-sectional diagram of this invention.

As shown in FIGS. 1-5, the embodiment of this invention provides a top spray-water outlet device. The top spray-water outlet device includes a top spray body 1, a switching device 2, clamping jaws 3 and elastic members 4. A water inlet 1A, a shower water outlet 1B and two top-spray water outlets 1C are provided in the middle of the upper end of the top spray body 1. The water inlet 1A is respectively connected to the shower water outlet 1B and the top spray water outlet 1C. The top spray body 1 includes a cover body 11 and a bottom plate 12. A T-shaped drainage groove 1211 is fixedly connected to the bottom plate 12, and a cover plate 1212 is inserted inside the drainage groove 1211. The cover plate 1212 is sealed with the drainage groove 1211 to form a water outlet channel 121, and a water inlet channel 111 is arranged above the cover plate 1212. A water inlet pipe 1213 is inserted into the water inlet channel 111. The switching device 2 includes a switch lever 21, a seal 22 and a limit joint 23. The water inlet channel 111 is arranged above the cover body 11. The cover body 11 and the bottom plate 12 can be detachably installed by screwing, which is convenient for assembly and replacement of parts. The shower water outlet 1B is provided on one side of the water inlet 1A. One end of the water outlet channel 121 is connected to the water inlet channel 111, and two sides of the water inlet channel 111 are each provided with a top-spray water outlet 1C. The two top-spray water outlets 1C are located at the ends of the two sides of the drainage groove 1211. A ball head device 7 is fixedly connected to the top of the water inlet 1A so that the top spray body 1 can adjust the angle arbitrarily. The hand shower 8 is fixedly connected to one end of the top spray body 1.

The switching device 2 is arranged on one side above the top spray body 1 to switch on or off the connection of the water inlet 1A with the shower water outlet 1B and with the top-spray water outlets 1C. The switch lever 21 is a hollow structure. One end of the switch lever 21 is fixedly connected with the handle 211. One end of the switch lever 21 is rotatably fitted in the shower water outlet 1B and inserted into the water inlet channel 111. The water passage hole 212 and the water passage groove 213 are respectively provided at two sides of the other end of the switch lever 21. The water passage hole 212 is connected with the inside of the switch lever 21. The seal 22 is fitted at the edge of the water passage hole 212; the limit joint 23 is fixedly installed at an opening of the shower water outlet 1B to limit the axial movement of the switch lever 21. With the rotation of the switch lever 21, the water inlet 1A is connected with the shower water outlet 1B by the water passage hole 212, and the water inlet 1A is connected with the top spray outlet 1C by the water passage groove 213. In this way, the hand shower 8 can spray water separately, the top spray can spray water separately, or the hand shower 8 and the top spray can spray water at the same time.

The upper and lower surfaces of the clamping jaw 3 are respectively provided with a rotating shaft 31 and a plurality of water outlet holes 32. The rotating shaft 31 is rotatably fitted at the top-spray water outlet 1C and movably sealed. The water inlet hole 33 is provided above the rotating shaft 31 and connected to the water outlet holes 32, and the water inlet 1A is connected to one end of the water outlet hole 32.

The elastic member 4 is arranged above the clamping jaw 3. Two rubber pads 6 are fixedly connected to opposite surfaces of the two clamping jaws 3. The rubber pad 6 can provide friction and cushioning during the fixing process of the hand shower 8, which is more secure and protective. The upper surface of the clamping jaw 3 is fixedly connected with a fixing column 34, the rotating shaft 31 is inserted into the top-spray water outlet 1C and fixed with a C-shaped fastener 5 and then the rotating shaft 31 can be prevented from being separated from the top-spray water outlet 1C. A tension spring is arranged inside the elastic member 4, and the tension spring is located inside the top spray body 1. The two ends of the tension spring are respectively connected to the inside of the top spray body 1 and the fixing column 34, so that the two clamping jaws 3 move toward each other under the action of the two tension springs to perform the clamping action. The first arc hole 122 provides a space for the displacement of the fixing column 34. The lower surface of the top spray body 1 is provided with the first arc hole 122, and the fixing column 34 is movably fitted in the first arc hole 122. One end of the upper surface of the clamping jaw 3 is fixedly connected with a snap joint 35, and the lower surface of the top spray body 1 is fixedly connected with a second arc hole 123, which can provide an upward pulling force for the clamping jaws 3 to prevent the clamping jaws 3 from falling down. The snap joint 35 is in rotating fit with the second arc hole 123 and hooked on an inner edge of the second arc hole 123.

Embodiment 2

The above-described top spray further includes sealing rings in necessary positions, such as the position between the upper end of the water inlet pipe 1213 and the lower end of the water inlet channel 111, the position where the switch lever 21 and the top spray body 1 are fitted together, the position where the rotating shaft 31 and the top-spray water outlet 1C are connected with each other, the inside of the clamping jaw 3 and so on.

Although the embodiments of this invention have been shown and described, it will be understood by those skilled in the art that the various modifications, changes, substitutions and variations of the embodiments may be made without departing from the spirit and scope of the invention. The scope of the invention is defined by the appended claims and their equivalents.

What claimed is:

1. A top spray-water outlet device, comprising a top spray body, a switching device, clamping jaws, and elastic members; wherein a water inlet, a shower water outlet and two top-spray water outlets are provided in a middle of an upper end of the top spray body, the water inlet is respectively connected to the shower water outlet and the two top-spray water outlets;

the switching device is arranged on one side above the top spray body;

an upper surface and a lower surface of each of the clamping jaws are respectively provided with a rotating shaft and a plurality of water outlet holes; each rotating shaft is rotatably fitted at a respective one of the two top-spray water outlets and is movably sealed therewith, a water inlet hole is provided above each rotating shaft and is respectively fluidly connected to the plurality of water outlet holes, the water inlet is fluidly connected to one end of each of the plurality of water outlet holes; and the elastic members are arranged above the clamping jaws.

2. The top spray-water outlet device according to claim 1, wherein the top spray body comprises a cover body and a bottom plate;

a water inlet channel is arranged above the cover body, and the shower water outlet is provided on one side of the water inlet; and one end of a water outlet channel is connected with the water inlet channel, and two sides of the water inlet channel are respectively provided with the two top-spray water outlets.

3. The top spray-water outlet device according to claim 2, wherein a T-shaped drainage groove is fixedly connected to the bottom plate, and a cover plate is inserted inside the drainage groove;

the two top-spray water outlets are respectively located at ends on two sides of the T-shaped drainage groove; and the cover plate and the T-shaped drainage groove are sealed to form the water outlet channel, the water inlet channel is arranged above the cover plate, and a water inlet pipe is inserted inside the water inlet channel.

4. The top spray-water outlet device according to claim 1, wherein the switching device comprises a switch lever, a seal and a limit joint;

the switch lever is a hollow structure, a first end of the switch lever is fixedly connected with a handle, and a second end of the switch lever is rotatably fitted in the shower water outlet and inserted into a water inlet channel;

a water passage hole and a water passage groove are respectively provided at two sides of the second end of the switch lever, the water passage hole is connected with an inside of the switch lever, and the seal is fitted at an edge of the water passage hole; and the limit joint is fixedly installed at an opening of the shower water outlet.

5. The top spray-water outlet device according to claim 1, wherein each rotating shaft is inserted into the respective one of the two top-spray water outlets and is fixed with a C-shaped fastener.

6. The top spray-water outlet device according to claim 1, wherein a tension spring is arranged inside each of the elastic members, and the tension springs are located inside the top spray body;

an upper surface of each of the clamping jaws is fixedly connected with a fixing column; and a lower surface of the top spray body is provided with two first arc holes, and each fixing column is movably fitted in a respective one of the first arc holes.

7. The top spray-water outlet device according to claim 1, wherein one end of an upper surface of each of the clamping jaws is fixedly connected with a snap joint, a lower surface of the top spray body is provided with two second arc holes, and each snap joint is in a rotating fit with a respective one of the second arc holes and is hooked on an inner edge of the respective second arc hole.

8. The top spray-water outlet device according to claim 1, wherein two rubber pads are fixedly connected to opposite surfaces of each of the two clamping jaws.

9. The top spray-water outlet device according to claim 1, wherein a ball head device is fixedly connected to a top of the water inlet, and a hand shower is fixedly connected to one end of the top spray body.

* * * * *